US008347527B2

(12) United States Patent
Thielen

(10) Patent No.: US 8,347,527 B2
(45) Date of Patent: Jan. 8, 2013

(54) SHOE SOLE WITH INTEGRATED SLIP PREVENTION ELEMENTS

(75) Inventor: Klaus Thielen, Schoenau am Koenigssee (DE)

(73) Assignee: Tecvision AG, Wals-Siezenheim (AT)

( * ) Notice: Subject to any disclaimer, the term of this patent is extended or adjusted under 35 U.S.C. 154(b) by 566 days.

(21) Appl. No.: 11/989,379

(22) PCT Filed: Jun. 20, 2007

(86) PCT No.: PCT/EP2007/005454

§ 371 (c)(1),
(2), (4) Date: Apr. 22, 2010

(87) PCT Pub. No.: WO2007/147589

PCT Pub. Date: Dec. 27, 2007

(65) Prior Publication Data

US 2010/0199525 A1 Aug. 12, 2010

(30) Foreign Application Priority Data

Jun. 22, 2006 (DE) ..... 10 2006 028 666

(51) Int. Cl.
*A43C 15/14* (2006.01)

(52) U.S. Cl. ..... 36/61; 36/134

(58) Field of Classification Search ..... 36/59 R, 36/67 R, 61, 134

See application file for complete search history.

(56) References Cited

U.S. PATENT DOCUMENTS

| | | | | |
|---|---|---|---|---|
| 5,337,494 | A | 8/1994 | Ricker | |
| 5,497,565 | A | 3/1996 | Balgin | |
| 5,557,865 | A * | 9/1996 | Sjosvard | 36/61 |
| 5,836,092 | A | 11/1998 | Yarnell | |
| 5,870,838 | A * | 2/1999 | Khayat | 36/61 |
| 6,125,556 | A * | 10/2000 | Peckler et al. | 36/127 |
| 6,256,907 | B1 * | 7/2001 | Jordan et al. | 36/61 |
| 6,389,714 | B1 * | 5/2002 | Mack | 36/61 |
| 7,788,828 | B2 * | 9/2010 | Krouse | 36/61 |
| 2011/0047817 | A1 * | 3/2011 | Francello et al. | 36/29 |
| 2011/0047830 | A1 * | 3/2011 | Francello et al. | 36/134 |

FOREIGN PATENT DOCUMENTS

| | | | |
|---|---|---|---|
| CA | 2 487 770 | A1 | 6/2006 |
| CH | 636 508 | A5 | 6/1983 |
| DE | 19 57 191 | A1 | 6/1970 |
| EP | 1 621 093 | A2 | 2/2006 |
| FR | 2 788 414 | A | 7/2000 |

* cited by examiner

*Primary Examiner* — Marie Patterson
(74) *Attorney, Agent, or Firm* — Kilpatrick Townsend & Stockton LLP

(57) ABSTRACT

A shoe sole and a shoe comprising such a shoe sole are described, with the shoe sole being equipped with integrated anti-slipping elements which are adjustable between an inactive position and an active position by means of a central actuation unit. This arrangement is characterized in that the anti-slipping elements, which in particular have the form of spikes, are respectively supported in individual functional units and are axially adjustable between their active and inactive positions through rotation by the central actuation unit via at least one flexible drive element.

26 Claims, 9 Drawing Sheets

SHOE SOLE WITH INTEGRATED SLIP PREVENTION ELEMENTS

Figure 1:
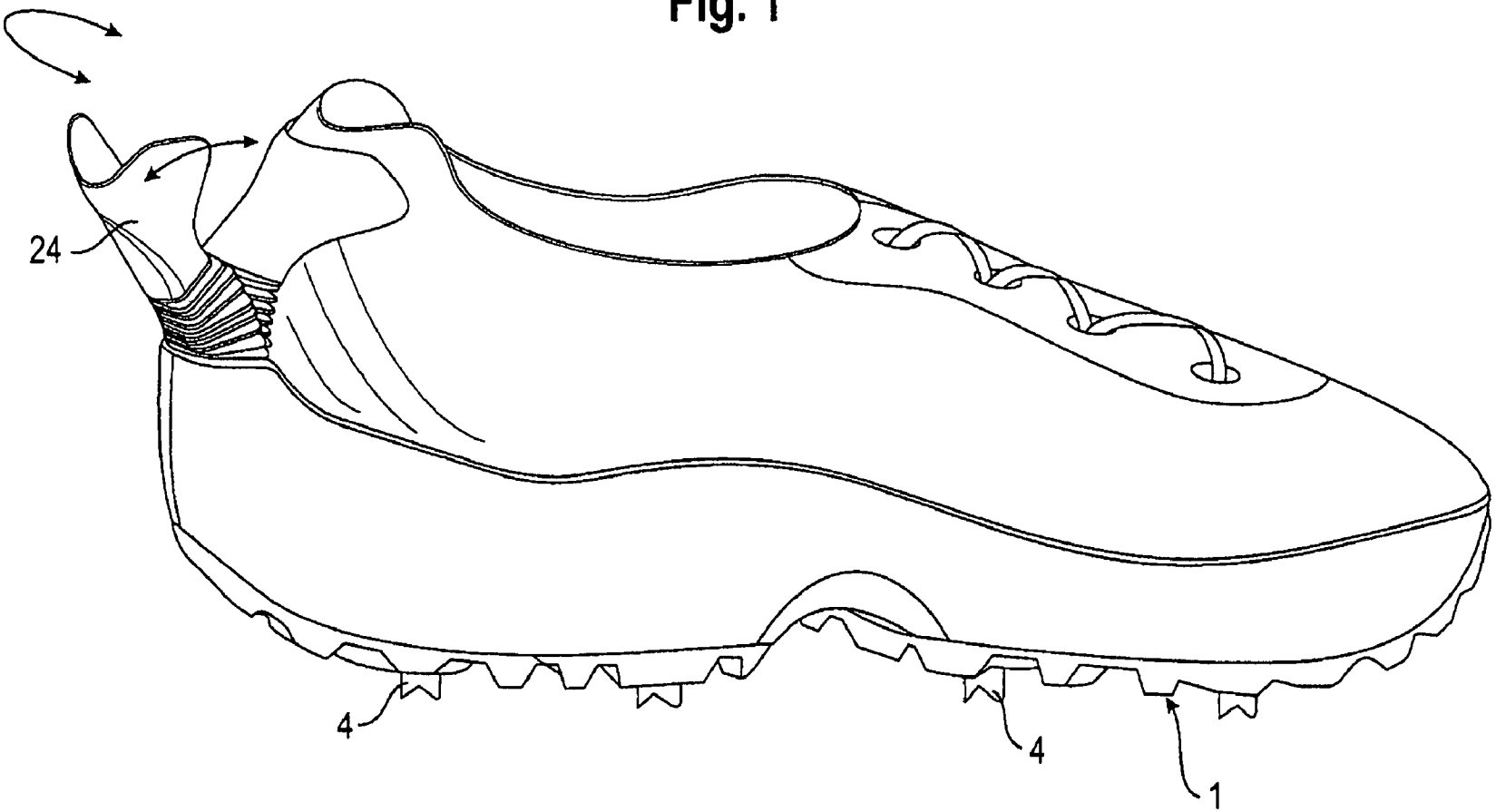

This application is a U.S. National Phase and claims the benefit of PCT Patent Application No. PCT/EP2007/005454, filed Jun. 20, 2007, which claims the priority of German Patent Application No. 10 2006 028 666.9, filed Jun. 22, 2006, the disclosure of which is incorporated herein by reference The invention relates to a shoe sole with integrated anti-slipping elements which can be adjusted between an inactive position and an active position by means of a central actuation unit. The invention is furthermore directed to all types of shoes which are provided with such a shoe sole with integrated anti-slipping elements.

Shoe soles with integrated anti-slipping elements which can be adjusted between a non-active position, i.e. a position set back with respect to the tread, and an extended and thus active position are known in different embodiments.

Reference can be made in this connection, for example, to EP 1 621 093 A3, U.S. Pat. No. 5,497,565 and U.S. Pat. No. 5,337,494.

All of these known solutions have the disadvantages that they can quickly become impaired with respect to their adjustment function under adverse conditions, in particular on heavy contamination or at low temperatures; that a permanent operational reliability of the switchover drive can only be ensured with great difficulty; and, above all, that the total construction design does not permit economic production, in particular not mass production.

It is the object of the invention to design a shoe sole of the initially stated kind, and thus also a shoe equipped with such a sole, in such a manner that operational reliability is also always ensured under adverse conditions; that the integration of the anti-slipping elements and their drive into the shoe sole does not disturbingly impair the running properties and roll-off properties of the respective sole; and, above all, that the total construction design is simple and a cost-effective production and a problem-free adaptation to the respective design of the sole is made possible.

This object is substantially satisfied in that the anti-slipping elements, which in particular have the form of spikes, are respectively supported in individual functional units and are axially adjustable between their active and inactive positions through rotation by the central actuation unit via at least one flexible drive element.

By providing individual functional units of identical design and their drive via flexible drive elements, in particular in the form of flexible threaded spindles or flexible control wire drives or control belt drives, by a central actuation unit, a simple and operationally reliable total design is ensured, on the one hand, and a problem-free matching ability to the respective shoe sole is ensured, on the other hand, with the total arrangement preferably being integrated into said shoe sole by an injection process on the manufacture of the shoe sole. It is furthermore of particular importance that the axial adjustment of the anti-slipping elements is always associated with a rotary movement of the anti-slipping elements and thus every type of imaginable blocking actions of the anti-slipping elements is countered extremely effectively and blocking phenomena are practically precluded.

A particularly advantageous realization of the invention is characterized in that each functional unit includes a housing in the form of a shallow pot in which a rotatably supported drive disk is provided which cooperates with a respective flexible drive element and either has a central extension or neck which engages into a central recess of the anti-slipping element while forming a rotationally fixed coupling which ensures an axial relative displacement, said anti-slipping element cooperating via radially projecting guide cams with a spiral ramp fixed to the housing, or has, instead of the central extension two mutually diametrically opposed extensions or necks in the form of drive wings which extend perpendicular to the drive disk and engage at the radially projecting guide cams of the anti-slipping element.

To promote the easy motion and to reduce the drive forces, the drive wings cooperate with the guide cams via sloped surfaces deflecting rotary drive forces in the axial direction.

The functional units can be realized with small volumes, ensure an easy motion in the adjustment of the anti-slipping elements due to the cooperation of the spiral ramp and the guide cams and avoid any need for force support by springs or the like.

The inner space of each functional unit which receives the actuation elements such as the drive disk and the anti-slipping element is outwardly practically sealingly terminated, with it above all also being a contributory factor that the housing of the functional unit is surrounded by a plastic jacket which fixes the outer contour of this functional unit and which is realized in an injection molding process.

A further particular advantage of the embodiment in accordance with the invention consists of the fact that the cooperating surfaces of the spiral ramp and the guide cams extend at least substantially perpendicular to the axis of rotation of the anti-slipping element and form support surfaces between the anti-slipping element and the housing which are in particular metallic and are free of transverse, force components in the active extended position of the anti-slipping element.

In the extended position, the support surfaces are preferably disposed in a type of undercut which ensures, on the'one hand, that the extension position is also clearly mechanically defined and, on the other hand, that a problem-free retraction from this extended position into the inactive position is possible.

It is above all ensured by this embodiment that the forces acting on the anti-slipping elements in the active, extended position are fully absorbed by the respective support surfaces and thus no forces have to act on or be absorbed by the actuation unit. In the extended position, the anti-slipping elements thus behave like anti-slipping elements connected or screwed to the sole in a stable manner, for example.

Generally, the part of the anti-slipping element provided for the outward projection can also be designed as a replaceable part so that the part exposed to wear can be changed independently of the adjustment mechanism or, optionally, different elements can be used in dependence on the respective field of application.

The embodiment of the connection between the central actuation unit and the individual functional units via flexible guide passages which accept threaded spindles, belts or wires extending from the central actuation unit to the respective functional units and ensure their guidance with an easy motion and a low friction is likewise of particular advantage. These guide passages are preferably designed in the form of two plastic passages substantially of more U shape which can be coupled to one another. In the case of the use of flexible wires or belts, the central actuation unit can preferably consist of a rotatably supported roll which is arranged in a bearing shell housing connected to the guide passages, with the guide passages opening in the bearing shell housing substantially perpendicular to the roll axis either themselves or via deflection units so that the wires or belts can be wound onto or unwound from the roll without problem.

The mentioned roll operative in both directions of rotation and serving for the winding up of the wires or belts is connected to a flexible drive bar likewise integrated into the sole material via a corresponding outer sleeve and having an actuation grip provided outside the sole. This actuation grip can be pivoted via a corresponding pivot bearing and suitably provided latch positions between an actuation position in which the drive bar can be rotated and a position contacting the respective shoe.

An advantageous special feature of the invention furthermore consists of the fact that the jacket of the functional units, the U-shaped guide passages, the deflection units and the bearing shell for the actuation unit consist of a one-part injection molded plastic part with which a likewise one-part cover unit of complementary shape for the functional units, the guide passages, the deflection units and the bearing shell is associated. The injection molded plastic part and the cover unit can be connected to one another, in particular clipped to one another, in a shape matched manner so that a closed, fully functional unit is present in the assembled state which can then be integrated without problem into the respective sole material, preferably within the framework of an injection molding process.

The positioning of the unit in accordance with the invention in the respective sole takes place in the manner such that the guide passages are arranged in accordance with the extent of the neutral bending fiber, whereby the lowest possible material strain results.

A particularly easy motion and a secure operation of the total arrangement is also achieved in accordance with the invention in that not all the functional units are connected in series with respect to the control drives of the spindle, the wire or the belt, but that rather a group of functional units, driven by the same actuation unit, for example, are combined in the front sole region and a group of functional units are combined in the heel region, with only the units within the same group being driven in series, but with a parallel connection of the drive being present with respect to the units in the front sole region and in the heel region.

The subject of the invention is not only the sole of the shoe per se, but also any shoe equipped with such a sole, with the sole being connected to the shaft upper part in the conventional manner, in particular by adhesive bonding, to form the finished shoe.

Further advantages embodiments and features of the invention are set forth in the dependent claims and are explained at least in part in the explanation of an embodiment shown in the drawing.

Figure 2:
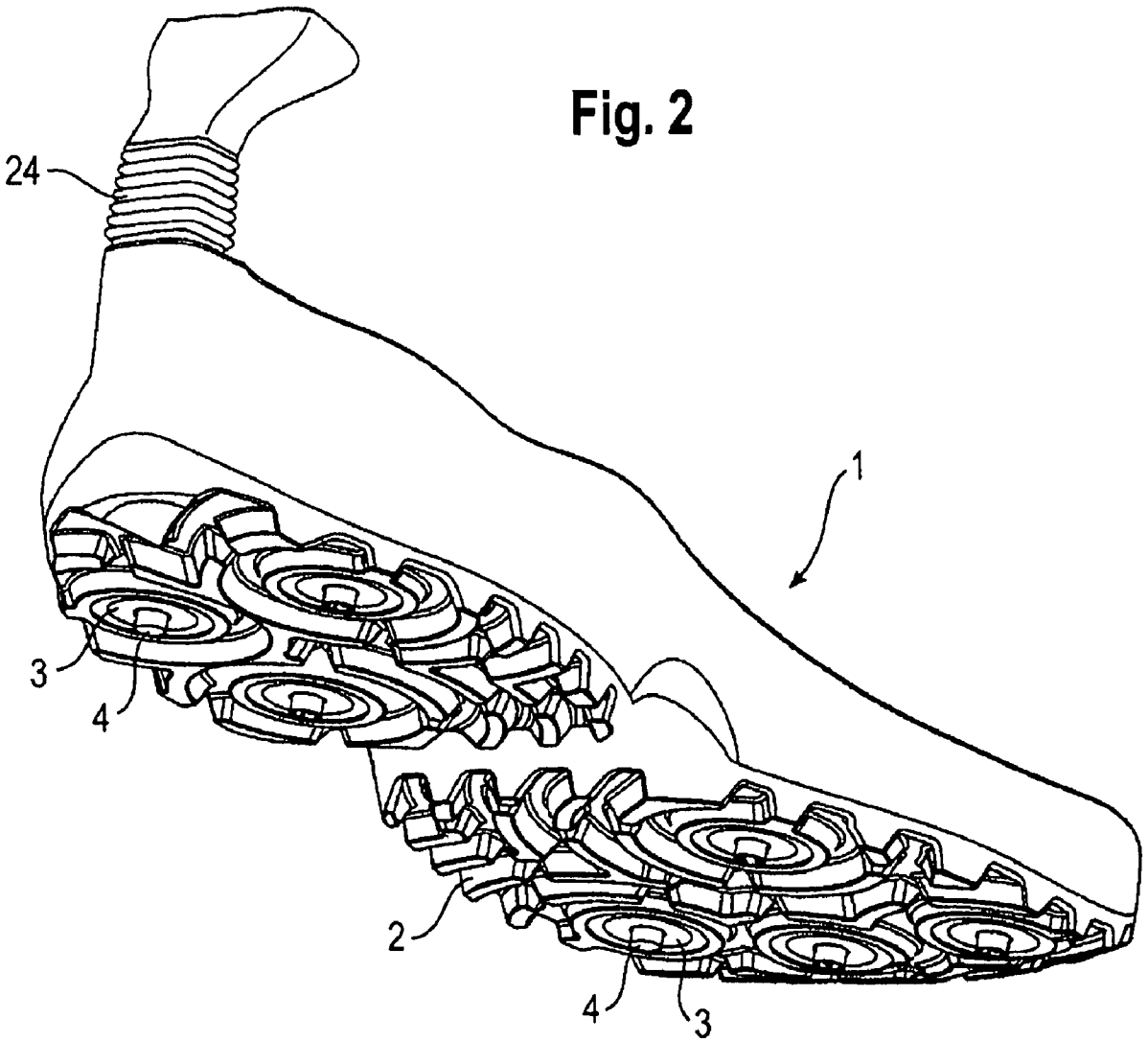
Figure 3:
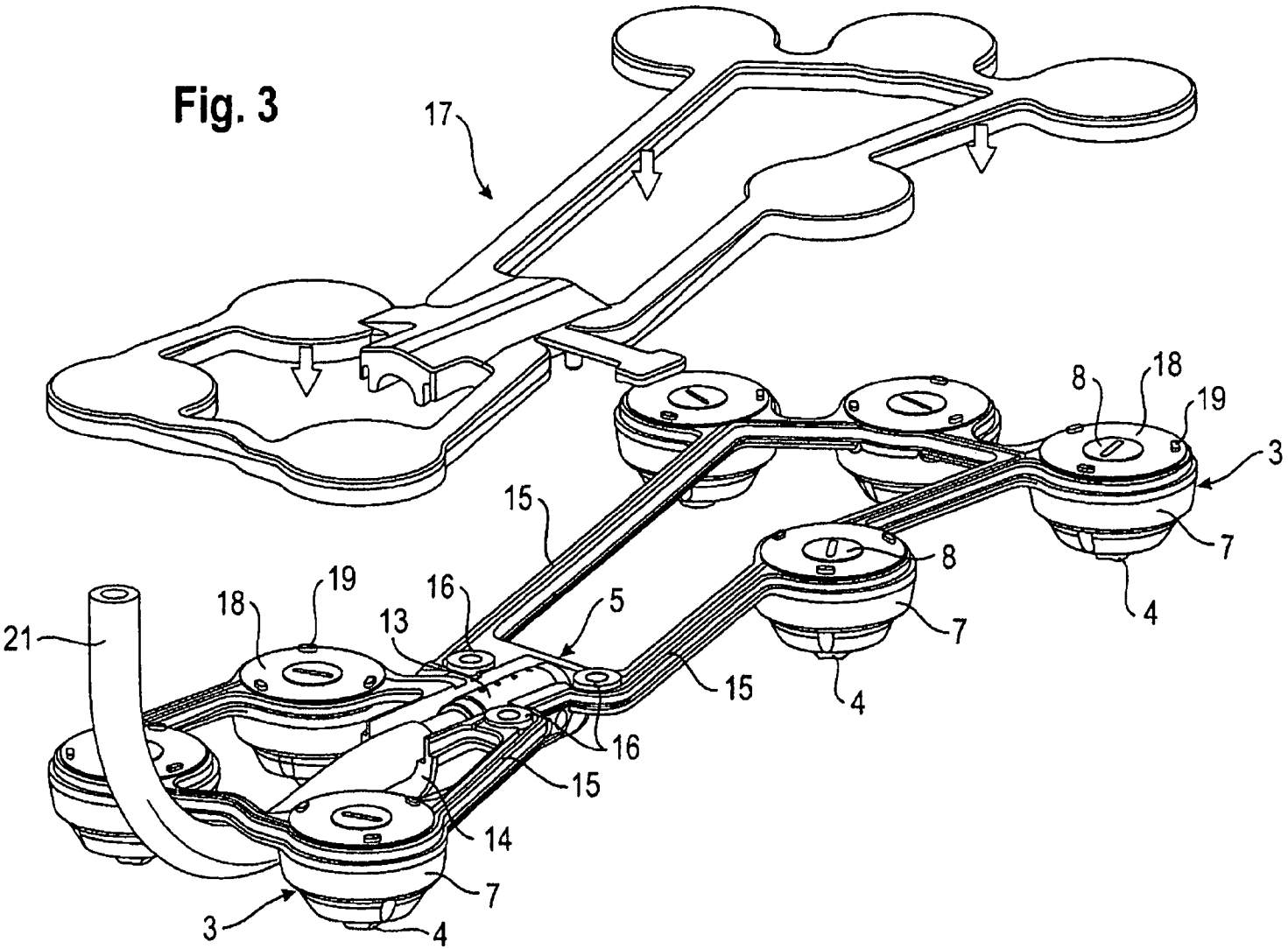
Figure 4:
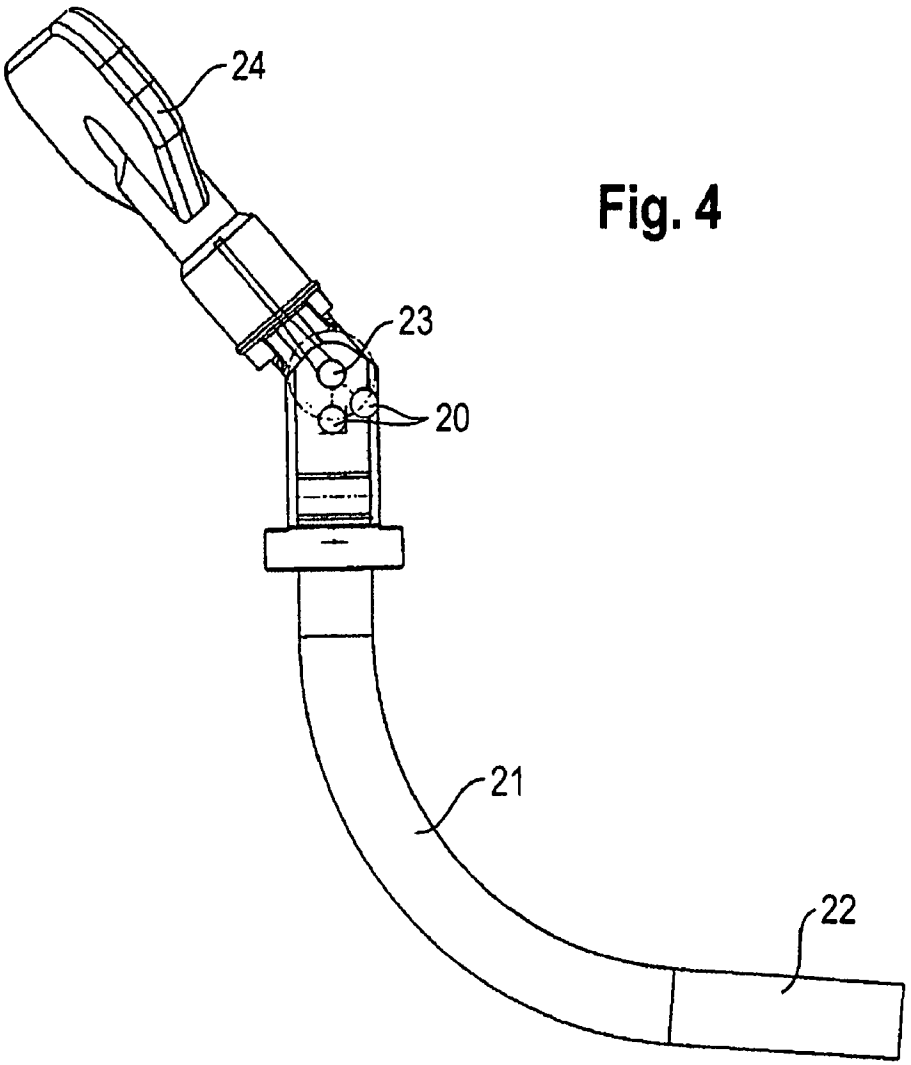
Figure 5:
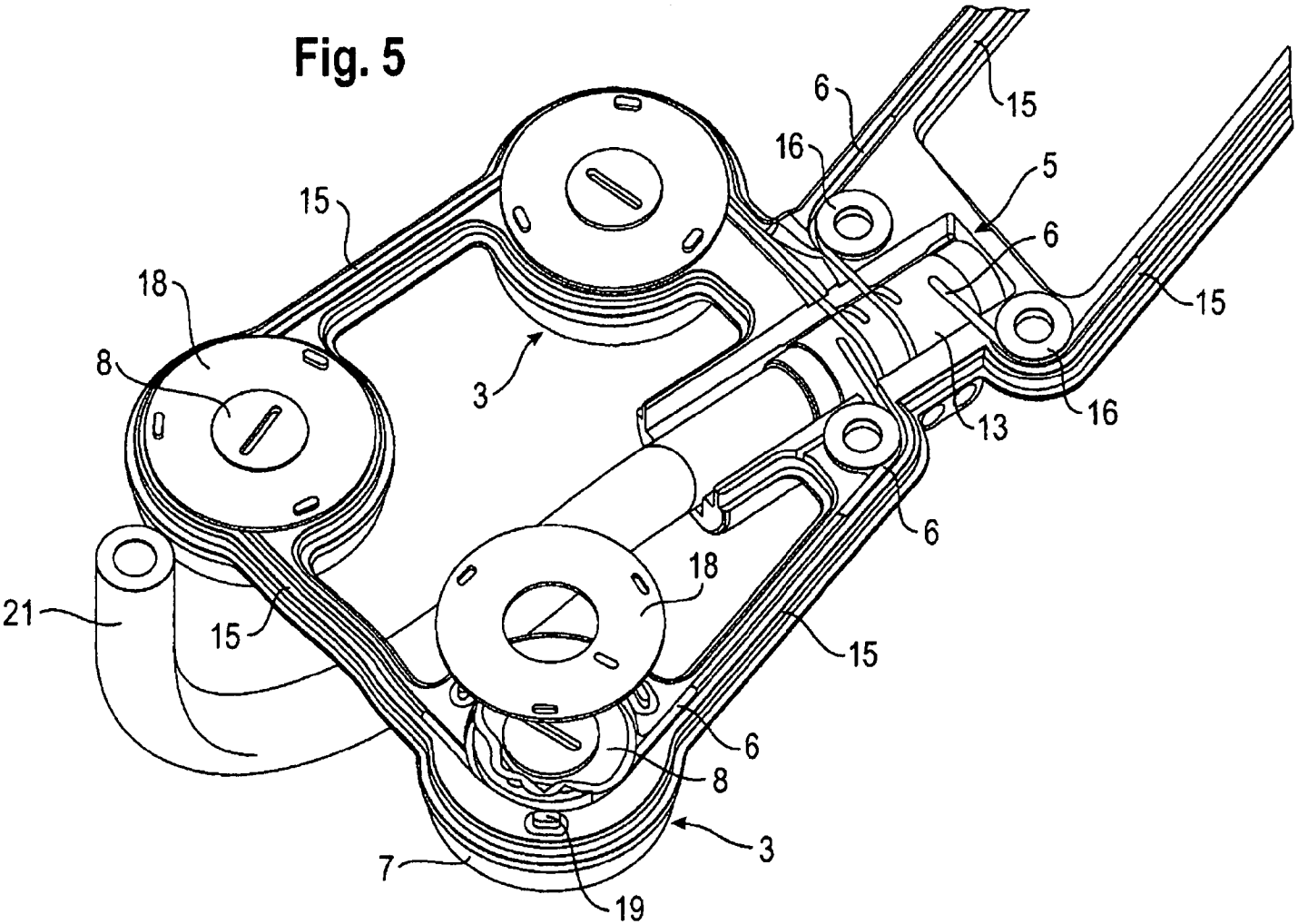
Figure 6:
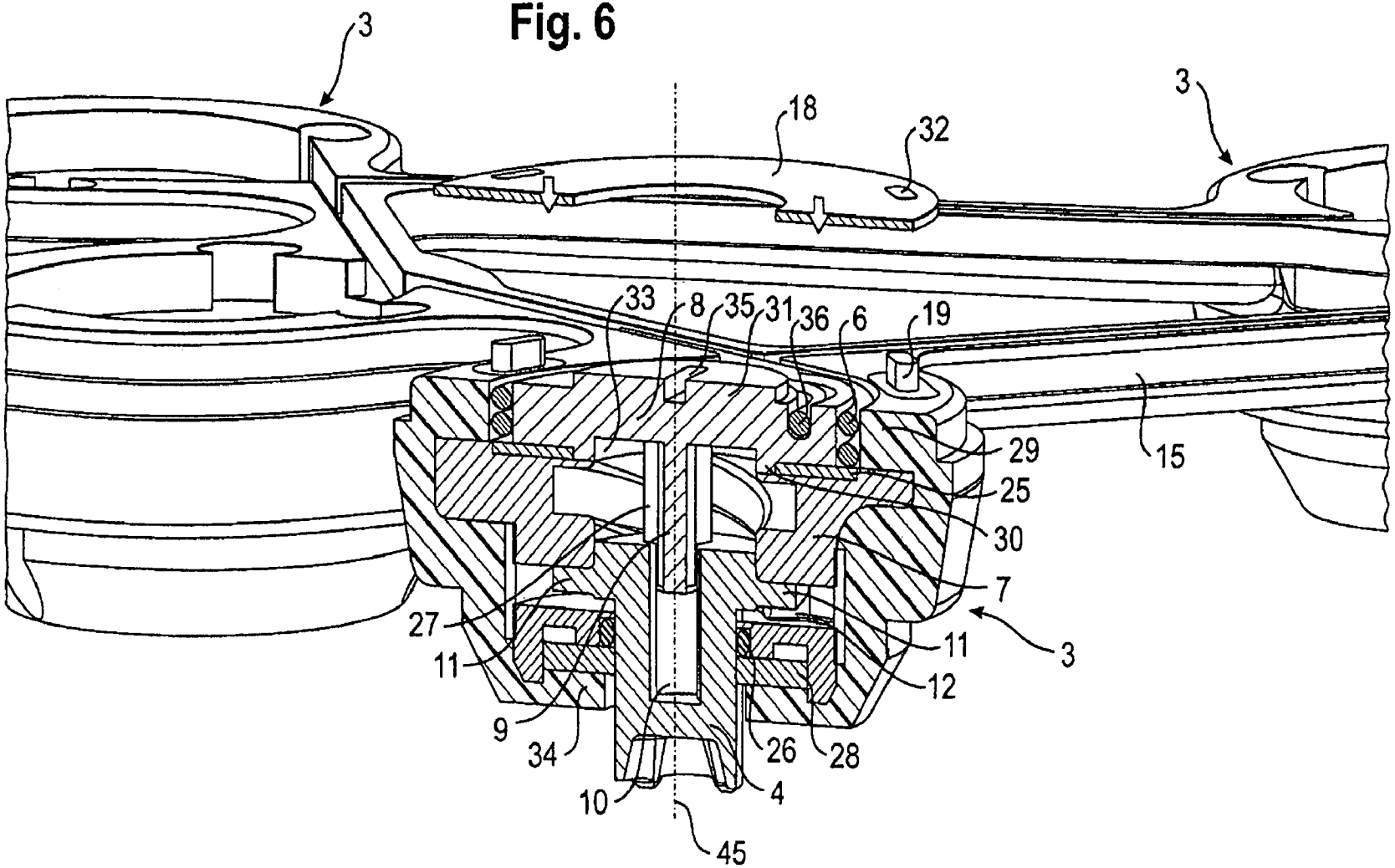
Figure 7:
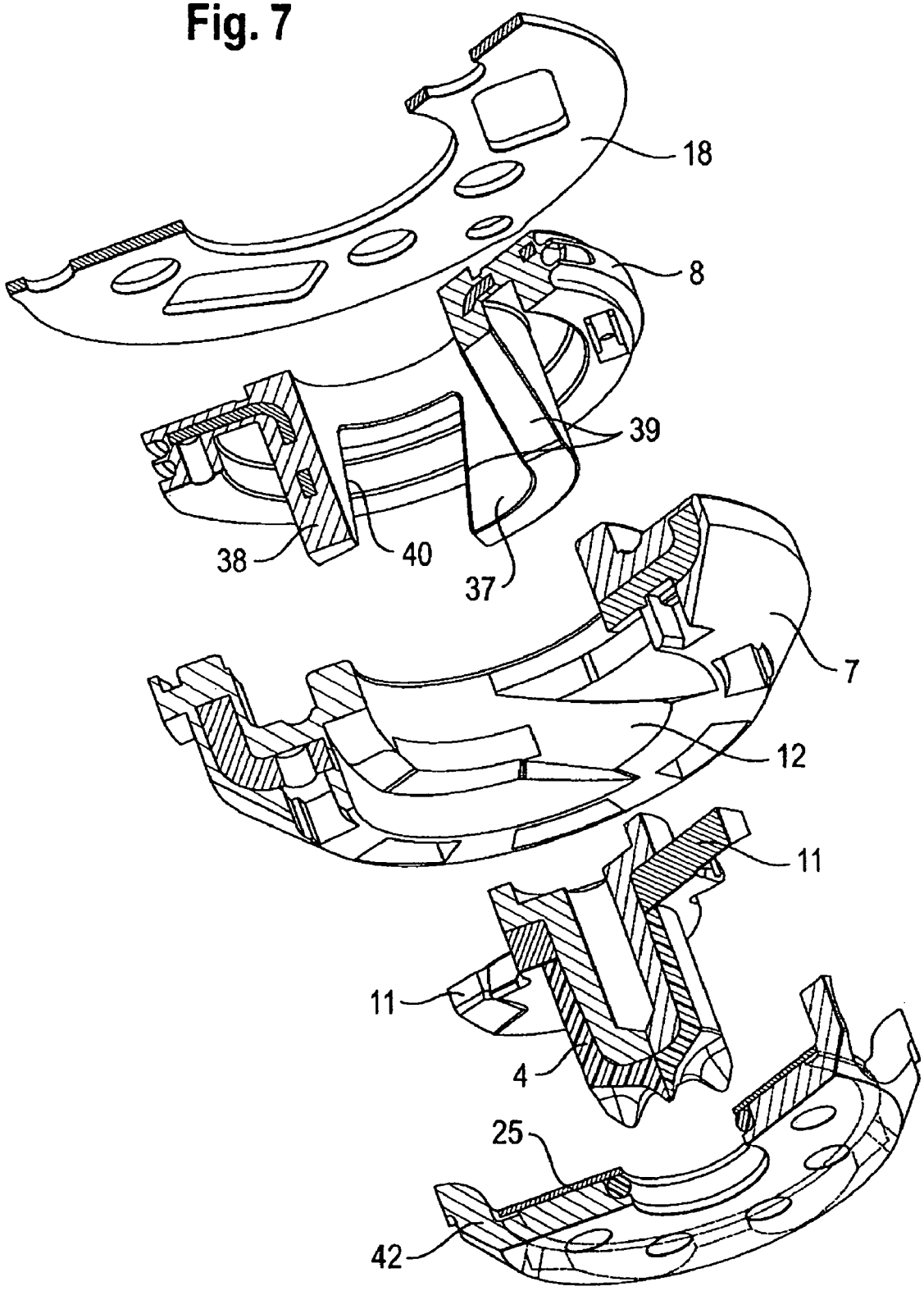
Figure 8:
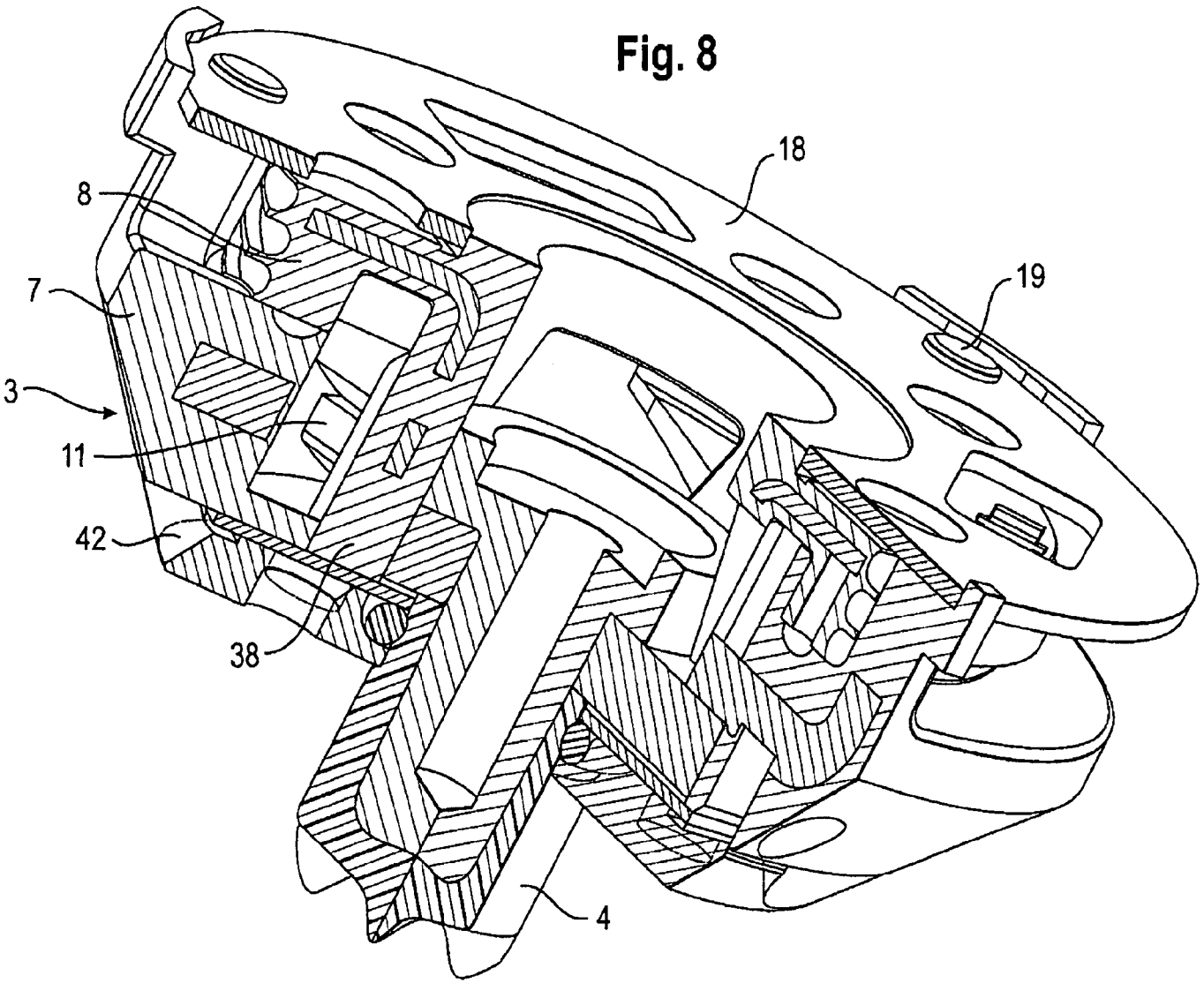
Figure 9:
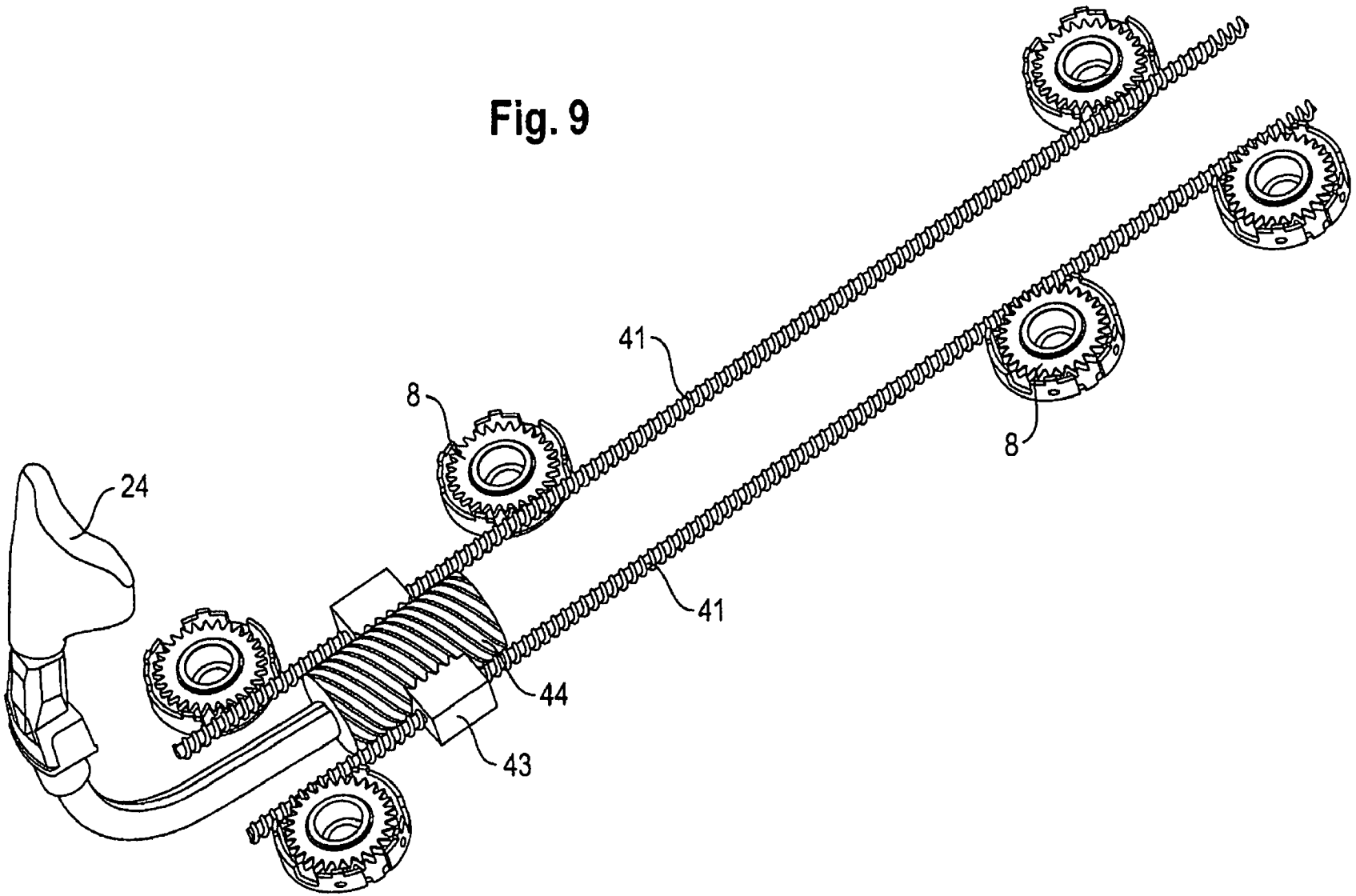

There are shown in the drawing:

FIG. 1 a perspectively represented side view of a sports shoe in accordance with the invention with extensible anti-slipping elements;

FIG. 2 a perspective oblique view of an embodiment of a shoe sole in accordance with the invention;

FIG. 3 a perspective representation of functional units connected to one another via guide passages and with an associated cover unit before the integration into the respective sole;

FIG. 4 a detail of the drive unit provided for the actuation of the anti-slipping elements with a pivotable actuation grip;

FIG. 5 a perspective detailed view of the heel-side region with functional units and actuation unit;

FIG. 6 a sectioned representation of a functional unit for the explanation of the detailed structure;

FIG. 7 a perspective representation of the main components of a further embodiment of a functional unit;

FIG. 8 a perspective, partly sectioned representation of the functional unit in accordance with FIG. 7; and FIG. 9 a schematic representation for the explanation of a particularly preferred embodiment of the invention with a drive of the functional units via flexible threaded spindles.

FIG. 1 shows a sport shoe having a shoe sole 1 designed in accordance with the invention with anti-slipping elements 4 which can be moved between an inactive position and an active position shown in this FIG. 1. The technical detailed structure enabling this movement of the anti-slipping elements 4 will be explained in detail later. The actuation of the anti-slipping elements 4, which is possible comfortably and from the outside, takes place via an actuation grip 24 which is pivotable from a contact position at the shoe into an actuation position shown in FIG. 1 in which the anti-slipping elements can be moved between their two end positions by exertion of a rotary movement.

FIG. 2 shows the side of the tread 2 of a sole 1 and the distribution of functional units 3 with anti-slipping elements 4 over the front sole part and the heel part of the shoe sole 1.

FIG. 3 shows, in a perspective representation, an example for a total system which can be integrated into the respective shoe sole 1 after joining together of the two units shown and which in each case represents a completely assembled functional unit which can be brought into the shape provided for the injection molding of the sole, can be suitably positioned and can then be overmolded with the sole material.

This total system includes a number of functional units 3 which can be preset in the individual case in accordance with the given demands and with which in each case an extensible anti-slipping element 4 is associated.

Each functional unit 3 includes a housing 7 which has approximately the shape of a shallow pot, which is closed on the side disposed opposite the anti-slipping element 4 by means of a support cover 18 and whose design will be explained in detail later. The different components of the functional unit 3 are joined together on the assembly and are then enclosed in a plastic jacket within the framework of an injection molding process, with the respective unit 3 then being closed by a support cover 18 which is fixed by clamping bolts or rivet bolts 19.

The individual functional units 3 are connected to one another and to a central actuation unit 5 via guide passages 15 in which the wires or belts run by means of which the anti-slipping elements 4 are switched between the active and inactive positions via the actuation unit 5.

The guide passages 15 consist of plastic and are in particular made flexible in a preset manner such that the total system of functional units and guide passages does not disturbingly impair the bending properties of the respective sole.

The guide passages 15 are made U-shaped in cross-section so that the wires or belts can be guided with an easy motion in these passages for the actuation of the functional units. These guide passages 15 are preferably made in a straight line and they merge in the region of the actuation unit 5 into deflection units 16 which ensure that the wires can each be guided approximately perpendicular or slightly obliquely on the drive roll 13.

The guide passages 15 preferably merge tangentially into the respective functional units 3 so that the drive wires can be guided tangentially to a drive disk 8 provided in each functional unit 3.

The central actuation unit 5 is formed by a rotatably supported roll 13 arranged in a bearing shell housing 14 connected to the guide passages 15. This roll 13, around which the respective drive wires wind and which simultaneously ensures the fastening of the wires is arranged in a bearing shell 14 and is connected to a flexible drive bar 21.

The jacket of the housing 7 of the functional units 3, the U-shaped guide passages 15, the deflection units 16 and the bearing shell 14 for the actuation unit 5 consist of a one-part injection molded plastic part, with the components of the functional units 3 being positioned in the required manner in a corresponding mold on the injection of this part and being overmolded while forming the respective overall housing 7. After the attachment and fixing of the respective closure support cover 18, the attachment of the drive roll 13 and the manufacture of the required wire connections, the cover unit 17 which is shaped complementary to the basic structure can be applied and the total arrangement can thus be moved into the closed state. A guided plugging together with a simultaneous clipping preferably takes place between the two units.

A prefabricated, fully functional units is then available which is actuable via the drive bar 21 and which can be integrated into the respectively provided sole by an overmolding procedure.

FIG. 4 shows the flexible drive bar which is associated with the roll 13 and whose coupling end 22 can be introduced into the roll and can be fixedly connected to the roll.

The flexible drive bar 21, which is integrated into the sole material, has a pivot bearing 23 at its free, outwardly disposed end and an actuation grip 24 is hinged to said pivot bearing. Two latch positions 20 are associated with this actuation grip 24 or with its pivot bearing 23, with the position shown in the drawing corresponding to the position pivoted away in which—as indicated in FIG. 1—a rotation of the drive bar is possible. The second latch position corresponds to the contact position at the respective shoe to which the actuation grip 24 can be matched in a shape matched manner.

FIG. 5 shows, in a perspective detailed view, the cooperation of the actuation unit 5 with the associated functional units 3, which can also be termed spike domes. The cover unit 17, as is shown in FIG. 3, has not yet been applied to the guide passages 15 or the functional units 3 and the actuation unit 5 in the representation of FIG. 5.

It can clearly be seen that the wires of the control wire drives 6 are guided either directly via the respective guide passage 15 or via a deflection unit onto the drive roll 13 to which their ends are also fastened. The part region illustrated shows the functional units 3 disposed in the heel region of a sole with an already fixed support cover 18 in part and with a support cover 18 in part before its positioning and fixing via clamping bolts or rivet bolts 19.

Any suitable device can generally be used for the rotation of the drive roll 13, with at least in principle an electric, controllable drive also not being precluded provided that it is available in a corresponding compactness.

The sectioned representation of FIG. 6 shows the inner structure of a functional unit 3.

The drive disk 8 is rotatably supported in a housing 7 which has a rotationally symmetrical outer contour and a plastic jacket, with the wires 6 leading to the actuation unit 5 or to adjacent functional units 3 being wound around or connected to the outer periphery of said drive disk so that every movement of the wires 6 effected via the actuation unit 5 results in a rotation of the drive disk 8 in the one or the other direction.

The drive disk 8 is guided axially and radially with an easy motion between an outer closure disk or support disk 18 and an inner support disk 25, with the spacing between these two support disks 18, 25 being preset by a housing spacer region 29.

The axial guidance of the drive disk 8 is achieved by the support disks 18 and 25 and these support disks 18 and 25 also ensure the radial guidance via a cylindrical guide neck 31 or a ring neck 30 which are formed at the drive disk 8.

The drive disk 8 furthermore has a central extension or neck 9 which engages into a central recess 10 of the anti-slipping element 4 while forming a rotationally fixed coupling which ensures a relative axial displacement. For this purpose, the central extension is preferably provided with an external toothed arrangement 27 which engages into complementary shaped recesses in the anti-slipping element 4. This relative engagement takes place with clearance so that the relative axial movability between the central extension 9 and the anti-slipping element 4 is always ensured.

The housing 7 has a spiral ramp 12 at the inside which surrounds the anti-slipping element 4 and which cooperates with in particular two mutually diametrically opposed guide cams 11 which are made in one piece with the anti-slipping element 4.

Each rotation of the drive disk 8 accordingly results in a corresponding rotation of the anti-slipping element 4 around its axis 34 and, at the same time, with every rotation, the guide cams 11 slide on the spiral ramp 12 and thus move the anti-slipping element 4 in dependence on the direction of rotation between the active extended position and the inactive retracted position in which the inwardly disposed end of the anti-slipping element 4 moves into the housing recess 33.

The housing optionally has a closure cover 28, which is held by the housing 7, at the side of the exiting of the anti-slipping element 4 from the functional unit 3. If no such closure cover is provided, the housing 7 is in any case closed by a jacket wall 34 on the base side while leaving free the exit opening for the anti-slipping element 4 so that no foreign substances can penetrate into the housing, but so that the extension and retraction of the anti-slipping element 4 is not hindered.

If the anti-slipping element 4 is in the extended position, the guide cams 11 are supported in the housing on a support surface extending substantially perpendicular to the axis 34, which is equivalent to forces acting on the anti-slipping element 4 being fully absorbed by these support surfaces and not being able to act on the drive system. The drive system is thus solely determined for the actuation of the anti-slipping elements since, in the extended position, each anti-slipping element 4 is supported with force transmission and completely at the metallic housing 7.

If FIGS. 3 and 4 are considered together, it can be seen that all the functional units 3 connected via wire drives to the actuation unit 5 are actuated synchronously, and indeed both on the extension movement and on the retraction movement of the anti-slipping elements 4. Since each extension and retraction of the anti-slipping elements 4 is necessarily associated with a rotary movement of these elements around the axis 34, the movement of the anti-slipping elements 4 can also take place with a low force expenditure when a possible layer of ice or a hard layer of dirt is present at the sole while ensuring the seal tightness of the respective functional units since the rotary movement of the anti-slipping elements breaks away any dirt or ice bridge possibly present between the housing and the anti-slipping element without problem.

It is also of significance for the easy motion and operational security that all the functional units 3 do not necessarily have to be connected in series drive-wise, but that preferably at least two drive groups are formed for the functional units 3 and can be controlled via the common actuation unit 5. The functional units 3 are preferably combined to form part systems in the heel part, on the one hand, and in the front sole part, on the other hand, with the drive disks 8 of the functional units being connected in series in each part system, but the parts systems themselves being connected in parallel drive-wise.

This results in a reduction of friction and in an advantageous easy motion of the drive.

The system in accordance with the invention can be realized in a very space saving manner, with the total height of the functional units 3 being able to be disposed, for example, in the range from 10 to 13 mm and the height of the flexible guide passages 15 being able to amount to approximately 4 to 6 mm, for example. The same plastic is preferably used in each case for the realization of the housing 7, of the guide passages 15 and for the associated support of the actuation unit.

An ideal support and guidance of the drive disk 8 can be achieved by the use of very strong support disks 18 and 25 which in particular consist of a suitable steel. Each support disk 8 has an actuation slot 25 for the rotational positioning of the support disks, in particular on assembly. In addition, each support disk 8 is provided with a wire clamping arrangement 36.

FIG. 7 shows a further particularly preferred embodiment of a functional unit 3, with the main components being shown perspectively in the manner of an exploded representation. A drive disk 8 is rotatably supported in a housing 7 of the shape of a shallow pot which is completed by a lower housing cover part 42, analog to the embodiment of FIG. 6. This drive disk 8 has two mutually diametrically opposed extensions in the form of drive wings 37, 38. These drive wings 37, 38 also serve for the axial support of the drive disk 8, since the drive disk 8 is guided via these wings 37, 38 between the closure support cover 18 and a support disk 25 which is arranged in the lower housing cover part 42.

The drive wings 37, 38 cooperate with the guide cams 11 projecting radially from the anti-slipping element 4 in a manner such that, on a rotary movement of the drive disk 8, the drive wings 37, 38 move the guide cams 11 over the spiral ram 12 formed in the housing 7 between the two end positions, namely the retraced and extended positions of the anti-slipping elements 4.

To ensure a particularly easy motion of this movement, the contact surfaces of the drive wings 37, 38 with the guide cams 11 are formed as sloped surfaces 39, 40 and the corresponding engagement surfaces at the guide cams 11 are shaped in a complementary manner.

In comparison with the embodiment in accordance with FIG. 6, in the aspect in accordance with FIG. 7, not only the force transmission ratios between the drive disk 8 and the anti-slipping element 4 are improved, but an improved guidance of the drive disk over its shaped on drive wings is also achieved, with the outer surfaces of said drive wings curved in the manner of part of a circle being guided in the housing 7 at least in the region of their free ends.

The perspective representation of the functional unit with the components in accordance with FIG. 7 in the perspective representation in accordance with FIG. 8 allows it to be recognized that the individual components can be assembled very easily to form the finished functional unit since essentially only a plugging together of the individual elements with a subsequent riveting or pressing together of clamping bolts 19 has to take place. The anti-slipping element is as a rule made in two parts, with the inner part ensuring the actuation and made as a hollow part for the saving of weight preferably being adhesively bonded to the outer part consisting of hard metal.

FIG. 9 shows, in the form of a schematic basic diagram, a preferred embodiment of a drive for the individual functional units 8 distributed over the shoe sole while using threaded spindles 41 which are in particular flexible.

Such flexible threaded spindles are commercially available and thus cost-effective elements which are also characterized by wear resistance and which can be cut to length easily to the respectively required dimension. Each of these threaded spindles 41 is in meshing engagement with a worm gear 44 via a threaded block 43 unmovably fastened to the threaded spindle 41 such that the threaded spindles 41 in engagement with the worm gear are displaced in the longitudinal direction by rotation of the worm gear 44; in practice, a displacement path in the range of 20 mm is sufficient in most cases. The rotation of the worm gear 44 takes place via the actuation grip 24 analog to the arrangement already described in connection with FIG. 5.

The threaded spindles 41 are—which is not shown in FIG. 9 for reasons of simplicity—substantially guided over their total length in corresponding passages, which in particular also applies to the region of the functional units in which each drive disk 8 carries a toothed arrangement adapted to the threaded spindle 41 at the outer periphery of said drive disk so that a rotation of the drive disk 8 takes place in dependence on the respective longitudinal displacement of the threaded spindle 41 and an extension or retraction of the anti-slipping elements thus takes place in the respective functional units 3 in the manner already described.

A plurality of drive disks 8 can also be driven by each spindle in the embodiment of the drive of FIG. 9, in a corresponding manner to how this was already described in connection with the control wire drives, i.e. groups can be formed whose individual functional units can each be positioned in the desired region of the shoe sole.

The shoe sole in accordance with the invention can basically be used in conjunction with every type of shoe. Sports shoes, hiking boots, trekking boots, golf shoes and the like can preferably be provided with a sole in accordance with the invention. In every case, the utility value and practical value of the respective shoes are improved and the safety for the user is above all increased.

REFERENCE NUMERAL LIST

1 shoe sole
2 tread
3 functional unit
4 anti-slipping element
5 actuation unit
6 control wire drive or band control drive
7 housing in the shape of a shallow pot
8 drive disk
9 central extension or neck
10 central recess
11 guide cam
12 spiral ramp
13 drive roll
14 bearing shell
15 guide passage
16 deflection unit
17 cover unit
18 closure support cover
19 clamping bolt
20 latch position
21 flexible drive bar
22 coupling end
23 pivot bearing
24 actuation grip
25 bearing disk
26 O ring seal
27 serration

28 outer closure cover
29 spacer element
30 ring neck
31 cylindrical guide neck
32 fit recess
33 recess
34 base wall
35 actuation slot
36 wire clamping arrangement
37 drive wing
38 drive wing
39 sloping surface
40 sloping surface
41 flexible threaded spindle
42 lower housing cover part
43 threaded block
44 worm gear

The invention claimed is:

1. A shoe sole comprising:

anti-slipping elements which include radially projecting guide cams, a central actuation unit for moving the anti-slipping elements between an inactive position and an active position, individual functional units supporting the respective anti-slipping elements, a flexible drive element operatively coupled with the central actuation unit and the individual functional units for axially moving the flexible drive elements between the active and inactive positions through rotation caused by the central actuation unit, a housing shaped as a shallow pot associated with each functional unit, a spiral ramp fixed relative to the housing, a rotatably supported drive disk that cooperates with the flexible drive element and has first and second mutually diametrically opposed extensions in the form of drive wings which extend substantially perpendicular to the drive disk and engage the radially projecting guide cams of the anti-slipping elements, and free ends of the guide cams cooperating with the spiral ramp for axially moving the anti-slipping elements between the first and second positions when the flexible drive element is rotated by the central actuation unit.

2. A shoe sole in accordance with claim 1, characterized in that the drive wings cooperate with the guide cams via sloped surfaces deflecting rotary drive forces in the axial direction and the corresponding engagement surfaces at said guide cams are shaped in a complementary manner.

3. A shoe sole in accordance with claim 1, wherein said drive wings serve for the axial support of said drive disk by guiding said drive disk between a closure support cover of said individual functional unit and a support disk being arranged in a lower housing cover part of said individual functional unit.

4. A shoe sole in accordance with claim 3, wherein the outer surface of said drive wings are curved in the manner of a part of a circle and are guided in the housing at least in the region of their free ends.

5. A shoe sole having integrated anti-slipping elements which can be adjusted between an inactive position and an active position by means of a central actuation unit, wherein the anti-slipping elements are respectively supported in individual functional units and are axially adjustable between a first active and a second inactive position through rotation by the central actuation unit via at least one flexible drive element, and wherein each functional unit includes a housing in the shape of a shallow pot in which a rotatably supported drive disk is provided which cooperates with said flexible drive element and which has a central extension which engages into a central recess of the anti-slipping element while forming a rotationally fixed coupling and allowing a relative axial displacement of said anti-slipping element, and wherein said anti-slipping element cooperates via radially projecting guide cams with a spiral ramp fixed with respect to the housing for the axial movement of said anti-slipping element between said first and second positions.

6. A shoe sole in accordance with claim 1 characterized in that the flexible drive element is formed by a threaded spindle or threaded shaft, which is in particular flexible and which is in particular flexible and which is in engagement with a toothed peripheral rim of the drive disk.

7. A shoe sole in accordance with claim 5, characterized in that the flexible threaded spindle is arranged longitudinally displaceably over its length in a guide respectively associated with it and is displaceable in the axial direction by means of a rotatably supported worm gear.

8. A shoe sole in accordance with claim 5, characterized in that each threaded spindle or threaded shaft is in meshing engagement with the worm gear via a threaded block fixed to the spindle.

9. A shoe sole in accordance with claim 1, characterized in that the flexible drive element is formed by a control wire drive or a control belt drive.

10. A shoe sole in accordance with claim 5, characterized in that said drive disk has a recess which surrounds said central extension being made in the manner of a profiled bar for the reception of the inwardly disposed end of the anti-slipping element in the inactive position.

11. A shoe sole in accordance with claim 1, characterized in that the anti-slipping element has two mutually diametrically opposed guide cams in its rearward region whose free ends cooperate with the spiral ramp via sloped sliding surfaces in the axial adjustment region.

12. A shoe sole in accordance with claim 1, characterized in that the exit opening of the housing interspersed by the anti-slipping element is sealed with respect to the anti-slipping element, in particular via an O ring seal.

13. A shoe sole in accordance with claim 1, characterized in that the cooperating surfaces of the spiral ramp and the guide cam extend at least substantially perpendicular to the axis of rotation of the anti-slipping element in the active, extended position of the anti-slipping element and form support surfaces between the anti-slipping element and the housing which are free of transverse force components and which are in particular metallic.

14. A shoe sole in accordance with claim 1, characterized in that the anti-slipping element is made in two parts and consists of an inner support part and a replaceable, wear-resistant end part which can in particular be adhesively bonded or screwed to the inner part.

15. A shoe sole in accordance with claim 1, characterized in that the housing and the associated individual components are surrounded by a plastic jacket and guide passages for the flexible drive elements are provided between the central actuation unit and the functional units.

16. A shoe sole in accordance with claim 15, characterized in that all the functional units are preferably disposed in one plane and are connected to one another via said guide passages.

17. A shoe sole in accordance with claim 16, characterized in that said guide passages form a flexible support system, in particular closed per se, together with the outer jackets of the housings of the functional units.

18. A shoe sole in accordance with claim 17, characterized in that the guide passages are closed, have two shells and consists of flexible plastic.

19. A shoe sole in accordance with claim 18, characterized in that the jacket of the housing of the functional units, the U-shaped guide passages and the bearing shell for the actuation unit consist of a one-part injection molded plastic part with which a likewise one-part cover unit shaped in a complementary manner for the functional units, the guide passages and the bearing shell are associated.

20. A shoe sole in accordance with claim 19, characterized in that the injection molded plastic part can be coupled, in particular clipped, with the cover unit in a shape matched manner.

21. A shoe sole in accordance with claim 15, characterized in that the guide channels substantially disposed in one plane are arranged extending in an approximately corresponding manner to the neutral bending fibers of the sole in the state integrated in the shoe sole.

22. A shoe sole in accordance with claim 1, characterized in that the drive disks are driven in the front shoe region, on the one hand, and in the heel region, on the other hand, in each case in series by means of the drives moved by the common actuation unit.

23. A shoe sole in accordance with claim 1, characterized in that the actuation unit is disposed between the sole part and the heel part, and is connected via a flexible drive bar to an actuation grip provided outside the sole.

24. A shoe sole in accordance with claim 23, characterized in that said actuation grip is connected to the flexible drive bar via a pivot bearing; and in that two latch positions are associated with the pivot bearing of which the one corresponds to a pivoted away actuation position and the other corresponds to a shoe contact position.

25. A shoe sole in accordance with claim 1, characterized in that, for wire drives and belt drives, the central actuation unit consists of a rotatably supported roll which is arranged in a bearing shell housing connected to the guide passages, with the guide passages opening directly or via deflection units substantially perpendicular to the roll axis in the bearing shell housing; and in that, for flexible spindle drives or toothed shaft drives, a rotatably supported worm gear whose axis extends parallel to the longitudinally displaceable drive shafts in the coupling region is provided as the central actuation unit.

26. A shoe, in particular a sport shoe or a hiking boot having a shaft part and shoe sole in accordance with claim 1.

* * * * *